United States Patent [19]

Ponyicky

[11] Patent Number: 4,530,448

[45] Date of Patent: Jul. 23, 1985

[54] WALL MOUNTED LIQUID DISPENSER

[76] Inventor: John F. Ponyicky, 5472 W. 84th St., Parma, Ohio 44129

[21] Appl. No.: 493,625

[22] Filed: May 11, 1983

[51] Int. Cl.[3] ..... B67D 3/00

[52] U.S. Cl. ..... 222/181; 222/511; 222/505

[58] Field of Search ..... 222/181, 185, 325, 505, 222/511, 559; 251/257, 258, 260, 261

[56] References Cited

U.S. PATENT DOCUMENTS

| | | | |
|---|---|---|---|
| 3,269,606 | 8/1966 | Armstrong | 222/185 |
| 3,459,345 | 8/1969 | Chernak et al. | 222/505 |
| 3,902,637 | 9/1975 | Scheeler | 222/185 |

FOREIGN PATENT DOCUMENTS

| | | | |
|---|---|---|---|
| 2627891 | 1/1978 | Fed. Rep. of Germany | 222/505 |
| 1373097 | 11/1974 | United Kingdom | 222/181 |

*Primary Examiner*—H. Grant Skagg
*Attorney, Agent, or Firm*—Harlan E. Hummer

[57] ABSTRACT

A wall mounted liquid dispenser is described as having a vertically disposed tank in which liquid is stored, and a horizontally disposed valve assembly which is in juxtaposed position below the tank and controls the flow, by gravity, of liquid from the tank. The assembly has a vertical passageway which is aligned with the outlet opening of the tank through which liquid exits the tank. A valve stem and attached valve are reciprocable in a multi-diameter bore which is disposed longitudinally of the assembly. The valve is frusto-conically shaped and moves with the stem into and out of transverse blocking relation with the passageway. The end of the valve stem farthest from the valve, protrudes from the assembly and is pivotally attached to a lever which, when rotated in a direction away from the passageway, acts to move the valve out of blocking relation with the passageway, so that liquid is free to flow, by gravity, from the dispenser. The valve stem and valve are spring loaded to block the passageway, so that when the force to rotate the lever is removed, the valve stem and valve will return to their normal rest position where the valve blocks the passageway. The protruding end of the valve stem carries a pair of stops which engage the assembly to limit the return of the valve so that it will not become wedged in the bore to adversely affect operation of the dispenser.

15 Claims, 4 Drawing Figures

WALL MOUNTED LIQUID DISPENSER

BACKGROUND OF INVENTION

The invention relates to dispensing devices and, in particular, to wall mounted dispensers for liquid, such as a mouthwash.

U.S. Pat. Nos. 3,319,835 and 3,349,967 show and describe typical dispensers which utilize plunger-type assemblies that are pumped, by hand, to force liquid soaps, mouthwashes, etc. from the storage chamber of the dispensers. This is necessary, because the storage chambers of such dispensers are positioned vertically lower than the nozzle from which the liquid is dispensed. Such pumping devices are not too reliable in operation, especially for removing the small amount of liquid remaining at the bottom of the storage chamber of the dispenser.

The invention is directed to overcoming these problems by the provision of a dispenser with a simple valve assembly which allows liquid to flow, by gravity, from the dispenser.

Briefly stated, the invention is in a liquid dispenser which comprises a normally, vertically disposed hollow cylindrical container which has a funnel-shaped bottom that terminates in an outlet opening through which liquid passes as it flows, by gravity, from the dispenser. A valve assembly, provided to control the flow of liquid from the dispenser, comprises a reciprocable valve which closes and opens the outlet opening of the dispenser. Means are supplied for reciprocating the valve into and out of closing relationship with the outlet opening of the dispenser.

DESCRIPTION OF DRAWING

The following description of the invention will be better understood by having reference to the accompanying drawing, wherein.

DETAILED DESCRIPTION OF DRAWING

Figure 1:
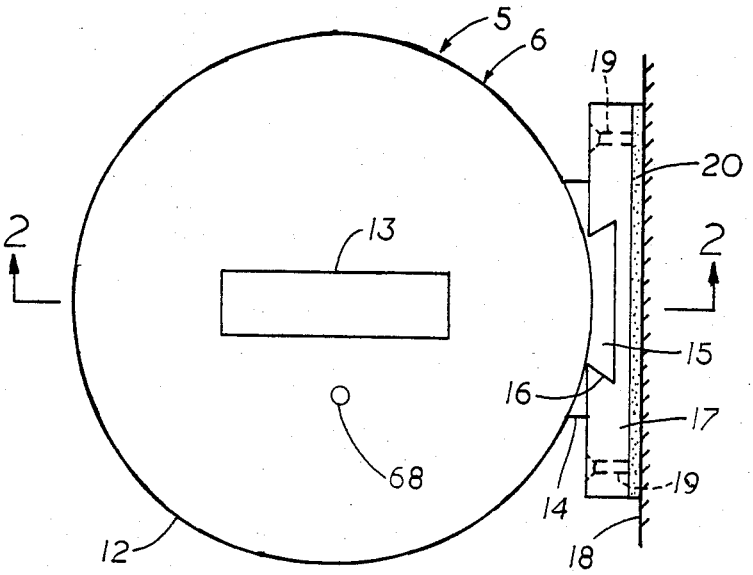
FIG. 1 is plan view of a wall mounted dispenser which is made in accordance with the invention.
Figure 2:
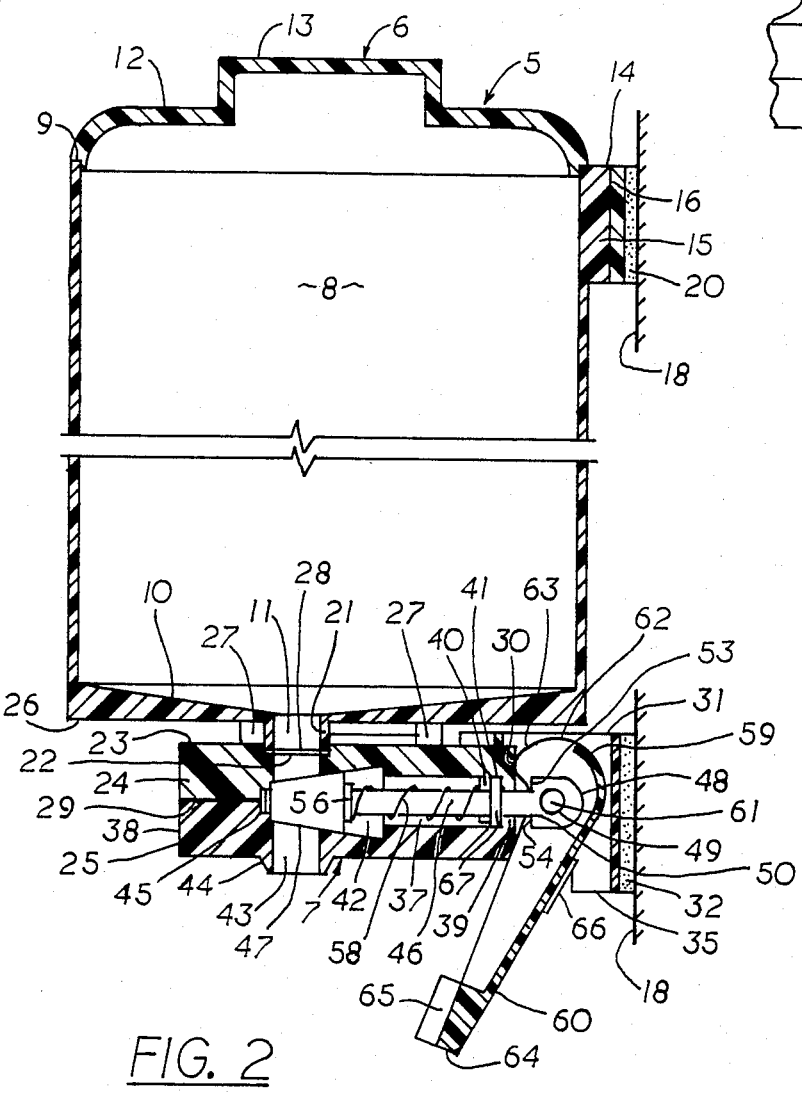
FIG. 2 is a section of the dispenser viewed from the line 2—2 of FIG. 1.

With particular reference to FIGS. 1 and 2, there is shown a dispenser 5 which is especially suitable for dispensing liquids, such as a mouthwash. The dispenser 5 comprises two main components of a hollow, cylindrical container 6 for storing liquid and a valve assembly 7 for controlling the flow of liquid from the container 6. These two components are made of any suitable material, e.g. plastic. The container 6 is normally vertically disposed, while the valve assembly 7 is generally horizontally disposed, when the dispenser is in a normal operating position, and these components will be described as though they are in such positions.

A vertically elongated storage chamber or tank 8 is formed within the container 6, and has an open top 9 and a funnel-shaped bottom 10 which terminates at a small, cylindrical outlet opening 11 through which liquid passes as it flows, by gravity, downwardly out of the storage tank 8. A cover or cap 12 is provided for closing the open top 9 of the tank 8, after liquid is poured into the container 6. The cap 12 is provided with an upstanding, elongated hand hold 13.

An adapter 14 is integrally formed with the container 6 adjacent the open top 9 of the tank 8. The adapter 14 has a downwardly tapered wedge 15 which is slidably and wedgingly received in a matingly tapered recess 16 that is formed in a bracket 17 which is designed for mounting on, for example, a bathroom wall 18 by any suitable means, e.g. screws 19 or gummed adhesive 20, as shown in FIGS. 1 and 2.

The outlet opening 11 in the bottom 10 of the tank 8, is provided with a surrounding, cylindrical wall or collar 21 which extends downwardly from the tank 8 for receipt in a matingly configured, annular recess 22 that is formed in the adjacent top side 23 of the valve assembly 7. Actually, the annular recess 22 is formed in the top side 23 of an upper section 24 of the valve assembly 7 which also includes a lower section 25. The two sections 24,25 of the valve assembly 7 are butted together in juxtaposed aligned relation by idiot or alignment pins (not shown) and then fastened to the underside 26 of the container 6 by a plurality of screws (not shown) which are threadably received in similar, outstanding cylindrical tapped projections 27 that extend downwardly from the underside 26 of the container 6.

Figure 3:
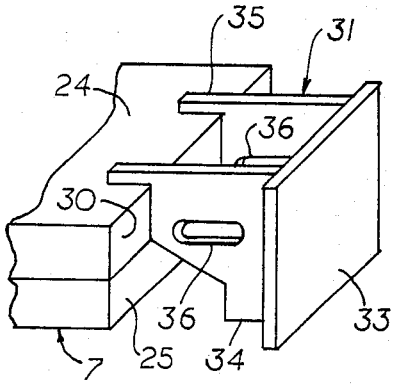
FIG. 3 is a perspective view of a portion of the valve assembly of the dispenser, showing the bifurcated bracket of the assembly.

An annular sealing ring 28, composed of any suitable soft plastic sealing material, is positioned in the annular recess 22 between the upper section 24 of the valve assembly 7 and the free distal end of the collar 21 which surrounds and helps define the outlet opening 11 of the container 6. A sealing gasket 29 is also placed between the upper and lower sections 24,25 of the valve assembly 7 to prevent any leakage of liquid from between the sections. The end 30 of the upper section 24, closest the bathroom wall 18 when the dispenser 5 is mounted thereon, is secured to a bifurcated bracket 31 (FIG. 3) which, in turn, is mounted on the wall 18 by any suitable means, e.g. gummed adhesive 32. The valve assembly bracket 31 comprises a flat wall plate 33 to which the adhesive attaches and from which projects a pair of generally triangularly shaped bracket arms 34,35, each of which has a horizontally elongated slot 36 which is located about midway between the top and bottom of each of the bracket arms 34,35.

A specially configured bore 37 is symetrically disposed in the sections 24,25 of the valve assembly 7. The bore 37 extends horizontally from the end 30 of the aligned sections 24,25, closest the bathroom wall 18, when the dispenser 5 is mounted thereon, inwardly of the sections 24,25, and terminates short of the opposing end 38 of the sections 24,25. An annular flange 39 restricts the bore 37 adjacent the wall end 30 of the valve assembly 7. A horseshoe or u-shaped stop 40 extends into the bore 37 in axial spaced relation from the annular flange 39 to also restrict the bore 37 and form with the flange 39 an annular groove 41. A frusto-conically shaped recess 42 is coaxially formed with the bore 37 and enlarges the bore 37 adjacent a cylindrical fluid passageway 43 which extends vertically through the valve assembly 7 in coaxial alignment with the outlet opening 11 of the juxtaposed tank 8. The fluid passageway 43 terminates at a flared nozzle 44 through liquid exits the valve assembly 7, when the fluid passageway 43 is at least partially open and unblocked. The bore 37 terminates just beyond the frusto-conically shaped recess 42 as a smaller diameter cylindrical opening 45.

A valve stem 46 and attached valve 47 for closing or blocking the fluid passageway 43 of the valve assembly, is reciprocable in the bore 37. The valve stem 46 is a solid, cylindrical rod which has a clevis-shaped enlarged head 48 with a pinhole 49 at one end 50, and a flared tip or flange 51 at the other opposing end 52. The flared tip 51 remains within bore 37 and seats in the smaller diameter opening 45 of the bore 37 when the valve 47 is closed in blocking relation with the fluid passageway 43. The enlarged head 48 protrudes from the bore 37 and valve sections 24,25, and is provided with a pair of shoulders 53,54 for abutting the annular flange 39 at the end 30 of the sections 24,25 and bore 37 therein.

Figure 4:
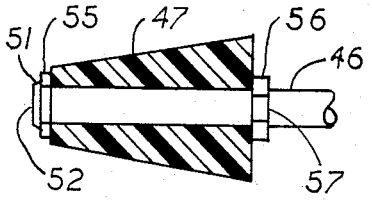
FIG. 4 is an enlarged section of the valve of the assembly.

The valve 47 surrounds the valve stem 46 adjacent the flared tip 51, and is composed of any suitable sealing plastic material. It is frusto-conically shaped for reception in the matingly configured recess 42 of the bore 37, and is detachable from the stem 46 for replacement, if required. The valve 47 is held in position on the valve stem 46 between a pair of spring-type, horseshoe or u-shaped plastic clips 55,56 which, as best seen in FIG. 4, interlockingly and frictionally engage the valve stem 46. The first clip 55 is placed between the flared tip 51 of the stem 46 and the valve 47. The second clip 56 is positioned in an annular recess or groove 57 that is formed in the stem 46 in axial spaced relation from the flared tip 51 a distance which is slightly larger than the correspondingly measured length of the valve 47. The second clip 56 also acts as an abutment for a metal coil spring 58 which surrounds the stem 46 between the clip 56 and the u-shaped stop 40 in the bore 37. The spring 58 acts to spring load or bias the valve 47 in a closed position where it transverses and blocks the fluid passageway 43 of the valve assembly 7.

The enlarged protruding head 48 of the valve stem 46, is pivotally connected to the bifurcated end 59 of a lever 60 for operating the valve stem 46 and attached valve 47, by means of a pivot pin 61, the opposing ends of which are slidably and pivotally received in the elongated slots 36 of the valve assembly bracket 31. The two similarly shaped heads 62 of the lever 60 have similarly curved camming surfaces 63 for engaging the adjacent end 30 of the aligned sections 24,25. The opposing free end 64 of the lever 60 is provided with a crosswise curving flange 65 which is designed to fit the curvature of the lip of a drinking glass and, against which a glass or finger holding such glass, can press to rotate the lever 60 rearwardly towards the bathroom wall 18. The camming surfaces 63 engage the adjacent end 30 of the sections 24,25 and force the attached stem 46 in a rearwardly direction to correspondingly move the valve 47 out of blocking relation with the fluid passageway 43, whereby liquid in the tank 8 is free to flow, by gravity, from the tank 8 through the outlet opening 11 and fluid passageway 43 for discharge from the flared nozzle 44 and dispenser 5. When force is removed from the lever 60, the compressed spring 58 reacts to return the stem 46 and attached valve 47 to its rest position where the valve 47 is closed in crosswise blocking relation with the fluid passageway 43 and the shoulders 53,54 on the head 48 of the stem 46 contact the adjacent end 30 of the valve assembly 7 to prevent further return of the valve 47 which could cause the valve 47 to become wedged in the bore 37 and adversely affect its operation. The backside of the lever 60 is provided with a longitudinally extending raised rib 66 which is designed to engage the backplate 33 of the valve assembly bracket 31 to prevent the lever 60 from contacting the bathroom wall 18, when the lever 60 is rotated to operate the valve 47. Any suitable sealing ring 67 is provided in the recess 41 in surrounding relation to the stem 46 to seal the bore 37 adjacent the enlarged head 48 of the stem 46. A vent hole is placed in the closure cap 12 of the container 6.

Thus, there has been described a unique liquid dispenser which has a simple valve assembly that has a horizontally reciprocating valve which opens and closes a fluid passageway through which liquid flows, by gravity, from a tank which is positioned vertically above the valve assembly. The parts are simply made, the only perceivably wearable part being the valve which is easily removed and replaced, if it becomes worn to the point of replacement. The dispenser is wall mounted, so that it is always in the same location for easy access and use.

What is claimed is:

1. A dispenser, comprising:

(a) a vertically elongated tank when the dispenser is mounted for operation, the tank having an inlet opening through which flowable material is placed in the tank and an outlet opening through which material, in the tank, flows from the tank, by gravity; and (b) a valve assembly for controlling the flow of material from the tank, including:

(I) an enclosed cylindrical fluid passageway which is vertically aligned with the outlet opening so that material will flow, by gravity, from the outlet opening through the passageway when the passageway is at least partially open and unblocked;

(II) a valve reciprocable along a horizontal axis into and out of blocking relationship with the passageway between opposing ends thereof, the valve including a horizontal valve stem which is attached to the valve and extends therefrom in a rearwardly direction from the passageway and front of the dispenser when the dispenser is mounted for operation, the valve stem having a free end which extends exteriorly of the valve assembly;

(III) means for spring-loading the valve in blocking relationship with the passageway;

(IV) a lever pivotally mounted on the free end of the valve stem for rotation in a vertical plane, the lever having a free end which extends below the passageway in converging relationship with the longitudinal axis of the passageway; and (V) means carried by the lever above the valve stem for coaction with the valve assembly adjacent the free end of the stem, for causing the valve to move in a direction away from the passageway to unblock the passageway when the free end of the lever is rotated in a direction away from the passageway.

2. The dispenser of claim 1, wherein the means (V) carried by the lever includes, a curved cam which projects from the lever in the direction of the passageway.

3. The dispenser of claim 2, wherein the valve assembly includes, a frusto-conically shaped bore which intersects and crosses the passageway between opposing ends of the passageway, and the valve is correspondingly shaped to reciprocate in the bore.

4. The dispenser of claim 3, wherein the valve surrounds the stem and is removable therefrom and is frusto-conically shaped.

5. The dispenser of claim 4, which includes means for detachably mounting the valve on the stem, including means for restricting movement of the valve axially of the stem.

6. The dispenser of claim 5, wherein the spring loading means includes a coil spring surrounding the stem and coacting between the valve and a stop which is spaced from the valve and which extends into a bore that is disposed in the assembly normal to the passageway and in which the stem and attached valve reside and reciprocate.

7. The dispenser of claim 6, which includes means for detachably mounting the valve assembly in juxtaposed relation vertically below the tank, when the tank is positioned such that the longitudinal axis thereof is vertically disposed.

8. The dispenser of claim 7, which includes means for sealing the bore so that flowable material will not leak therefrom if it gets into the bore, and a sealing ring surrounding the outlet opening between the outlet opening and aligned passageway.

9. A dispenser of flowable material, comprising:

(a) a hollow cylindrical container which defines a tank in which flowable material is stored, the tank having (i) an open top through which flowable material is poured into the tank, (ii) a funnel-shaped bottom spaced vertically below the open top of the tank when the tank is vertically disposed, the funnel-shaped bottom terminating at a circular outlet opening through which flowable material exits from the tank, by gravity;

(b) an annular wall surrounding the outlet opening and extending downwardly from the opening and tank;

(c) a removable closure cap for covering the open top of the tank;

(d) means adjacent the open top of the tank for mounting the container in vertical relation on a vertically disposed surface;

(e) a valve assembly detachably mounted in juxtaposed relation below the container for controlling the flow of material from the tank, the assembly including:

(f) an upper section and a lower section mounted together in juxtaposed relation below the container, the sections being generally horizontally disposed when the tank is vertically disposed, the sections having a circular fluid passageway extending vertically therethrough and being aligned with the outlet opening and sized in accordance therewith, an annular recess being formed around the passageway in the upper surface of the upper section closest the tank, for receiving the free distal end of the cylindrical wall which surrounds the outlet opening;

(g) an annular seal disposed in the annular recess between the upper section of the valve assembly and the tip of the wall surrounding the outlet opening of the tank to seal the space therebetween;

(h) a bore of different diameters disposed generally. symetrically, longitudinally of the sections, the bore extending transversely across the passageway and having a generally frustoconical shape in the area of the passageway, the bore extending into the sections from an outer surface which is farthest spaced from the passageway than the opposing outer surface of the secions;

(i) an annular flange extending into and restricting the bore adjacent the outer surface farthest spaced from the passageway;

(j) at least a semi-annular stop extending into the bore in axial spaced relation from the annular flange and forming with the flange a cylindrical groove therebetween;

(k) means coacting between the sections for sealing the space therebetween to prevent leakage of material from between the sections;

(l) a cylindrical valve stem mounted in the bore for axial reciprocating movement therein, the stem having at one end, an enlarged head which protrudes from the bore and sections adjacent the outer surface of the sections farthest spaced from the passageway, the head having a pair of shoulders for engaging said outer surface to prevent axial movement of the stem further in the direction of the passageway, the head also having a pinhole, and the stem having at the other end thereof a flared tip which extends beyond the passageway when the passageway is closed;

(m) a frusto-conically shaped valve carried by the stem adjacent the flared tip for reciprocation in the matingly shaped frusto-conically shaped portion of the bore, the valve designed to transversely block the passageway when the shoulders contact the outer surface of the sections farthest from the passageway;

(n) means for spring loading the valve in crosswise blocking relation with the passageway;

(o) means mounting the valve on the stem adjacent the flared tip thereof;

(p) a lever mounted on the enlarged head of the stem, the lever having a distal free end which is farthest spaced from the enlarged head of the stem and which extends below the passageway;

(q) means pivotally mounting the lever on the enlarged head of the stem by means of a pivot pin in the pinhole, for rotation in a plane such that the free distal end of the lever moves to and from the passageway;

(r) means coacting with the lever for causing the stem and attached valve to move in a direction away from the passageway to unblock the passageway when the free distal end of the lever is rotated in a direction away from the passageway; and (s) a sealing ring surrounding the stem in the cylindrical groove between the annular flange and the stop.

10. The dispenser of claim 9, wherein the spring loading means includes a coil spring around the stem and coacting between the stop and valve.

11. The dispenser of claim 10, wherein the means (r) for causing the stem and attached valve to move includes at least one camming surface formed on the end of the lever closest the pivot pin, the camming surface designed to rollingly engage the outer surface of the sections farthest from the passageway.

12. The dispenser of claim 11, wherein the valve mounting means includes a pair of horseshoe shaped clips engaging the stem on either side of the valve, the first of the clips being positioned between the valve and flared tip of the stem, and the second of the clips positioned in an annular recess formed in the stem a distance spaced from flared tip slightly greater than the overall length of the valve measured axially of the stem, the spring abutting the second of the clips.

13. The dispenser of claim 12, which includes a bracket secured to the upper section of the valve assembly adjacent said outer surface of the sections farthest from the passageway, the bracket having a plate from which extends a pair of parallel arms, each of which arms has an elongated slot in which opposing ends of the pivot pin are rotatably received, the slots being horizontally disposed when the tank is vertically disposed, the plate designed for abutting the vertical surface on which the container is mounted so that the tank will be held in a vertical position.

14. The dispenser of claim 13, wherein the means (d) for mounting the container includes a bracket separable from the container for mounting on said vertically disposed surface, the bracket including a wedge shaped recess for slidably and wedgingly receiving a matingly shaped wedge carried by the container.

15. The dispenser of claim 14, wherein the dispenser, except for the coil spring which is metal, is composed of plastic.

* * * * *